US005972075A

United States Patent [19]

Fukuda et al.

[11] Patent Number: 5,972,075

[45] Date of Patent: Oct. 26, 1999

[54] EXHAUST GAS PURIFIER AND REGENERATION METHOD THEREFOR

[75] Inventors: Kensei Fukuda, Saga-ken; Yoshinobu Kuwamoto, Ohnojo; Yasuhiro Fujiwara, Kasuga, all of Japan

[73] Assignee: Matsushita Electric Industrial Co., Ltd., Osaka, Japan

[21] Appl. No.: 08/910,831

[22] Filed: Aug. 31, 1997

[30] Foreign Application Priority Data

Aug. 29, 1996 [JP] Japan ..... 8-228088

[51] Int. Cl.[6] ..... B01D 29/62

[52] U.S. Cl. ..... 95/15; 95/22; 95/283; 55/282.3; 55/283; 55/DIG. 10; 55/DIG. 30; 96/420; 96/421; 96/422; 60/286

[58] Field of Search ..... 96/397, 425, 420, 96/421, 422; 55/DIG. 10, DIG. 30, 282.2, 282.3, 289, 283; 95/15, 14, 20, 19, 283, 22; 60/286, 288

[56] References Cited

U.S. PATENT DOCUMENTS

| | | | |
|---|---|---|---|
| 4,544,388 | 10/1985 | Rao et al. | 55/283 |
| 4,589,254 | 5/1986 | Kume et al. | 60/286 |
| 5,090,200 | 2/1992 | Arai | 55/DIG. 30 |

FOREIGN PATENT DOCUMENTS

| | | | |
|---|---|---|---|
| 719028 | 1/1995 | Japan . | |
| 2239615 | 7/1991 | United Kingdom | 55/DIG. 1 |

*Primary Examiner*—Jay H. Woo
*Assistant Examiner*—Robert Hopkins
*Attorney, Agent, or Firm*—Stevens, Davis, Miller & Mosher, L. L. P.

[57] ABSTRACT

In a purifier for removing particulates from an exhaust gas, a pressure difference, and a flow rate of the air supplied to the filter element is adjusted in such a manner that a difference between a pressure difference of an air across a substantially invariable air flow resistance before the air reaches a filter element collecting and storing the particulates therein and a reference pressure difference is a predetermined value, while heating the air.

15 Claims, 6 Drawing Sheets

EXHAUST GAS PURIFIER AND REGENERATION METHOD THEREFOR

BACKGROUND OF THE INVENTION AND RELATED ART STATEMENT

The present invention relates to a purifier for removing particulates from an exhaust gas generated by a combustion engine, a burner or the like, and a regeneration method therefor.

In a prior art exhaust gas purifier as disclosed by JP-A-7-19028 (particularly by FIG. 4 thereof), an orifice valve for measuring an air pump output flow rate in a relatively small air pump output flow rate and a valve for supplying a relatively large air pump output flow rate are arranged in parallel to each other between an air pump and a heater, are closed to isolate the air pump from the exhaust gas while collecting the particulates from the exhaust gas, and communicate with the exhaust gas at an upstream side of the heater. The air pump output flow rate is calculated from a pressure difference across the orifice valve.

OBJECT AND SUMMARY OF THE INVENTION

An object of the present invention is to provide an exhaust gas purifier and a regeneration method therefor, by which a flow rate of a heated air supplied to the particulates to regeneration a filter element is measured correctly.

According to the present invention, in a purifier for removing particulates from an exhaust gas, comprising, a filter element adapted to collect the particulates from the exhaust gas and store them therein, an air supplier arranged to urge an air toward the particulates in the filter element, a heater configured to heat the air before the air reaches the particulates in the filter element, and a pressure sensor arranged to measure a pressure difference of the air, since the purifier further comprises a substantially invariable air flow resistance (for example, substantially invariable cross sectional opening area of an air flow passage), and the pressure difference of the air across the substantially invariable air flow resistance is measured before the air reaches the filter element, a flow rate of a heated air supplied to the particulates to regenerate the filter element is measured correctly without being affected by variation of air flow resistance for measuring the pressure difference, so that the flow rate of the heated air is adjusted stably to a desired degree. Therefore, the particulates are burnt constantly over the whole of the filter element, and a local temperature difference and a quick temperature change in the filter element are restrained to prevent a damage or thermal shock of the filter element.

If an exhaust gas inlet opens between the filter element and at least a part of the heater to introduce the exhaust gas into the purifier therebetween, at least a remainder part of the heater other than the part thereof is prevented from contacting with and being contaminated by the exhaust gas, and a flow of the exhaust gas is prevented from being restrained largely by the heater.

If the substantially invariable air flow resistance is at least partially formed by at least a part of the heater, that is, the pressure difference across the substantially invariable air flow resistance includes or is equal to a pressure difference across the at least a part of the heater, an excessive air flow resistance for only measuring the pressure difference as opposed to air flow resistances requisite for forming, controlling and heating the air flow, is not necessary. Therefore, a total amount of air flow resistances through the purifier is minimized.

If the flow rate of the air toward the filter element is adjusted in such a manner that a difference between the pressure difference and a reference pressure difference is a predetermined value (for example, zero), and at least one of the predetermined value, the reference pressure difference and the pressure difference is modified in accordance with (for example, in proportion to) a temperature of the air measured after being heated by at least a part of the heater, a mass flow rate of the air is correctly adjusted to or kept at a desired degree, because the pressure difference varies in accordance with (in proportion to) an absolute temperature of the air changing a volume and/or pressure of the air in accordance therewith. It is preferable for an influence of a volume or pressure change of the air caused by an air temperature variation on the pressure difference to be eliminated to measure or obtain correctly the mass flow rate of the air and keep correctly it at the desired degree. For treating or burning sufficiently the particulates, the mass flow rate of the air is significantly or substantially important, but a volume flow rate of the air is relatively not substantially important.

It is preferable for correctly increasing a temperature of the particulates to treat or burn the particulates that a temperature sensor is arranged to measure a temperature of the air so that an output of the heater is adjusted in such a manner that the temperature is substantially equal to a reference temperature. The temperature sensor is arranged preferably to measure a temperature of the air after the air is heated by at least a part of the heater, and/or before the air flows out from the filter element. It is preferable that the temperature sensor is prevented from directly facing an exhaust gas inlet in a direction along which the exhaust gas flows through the exhaust gas inlet into the purifier.

The substantially invariable air flow resistance may be at least partially formed by a valve arranged to isolate the air supplier from the filter element when the exhaust gas is introduced into the purifier. A chamber may be formed between the heater and the filter element so that the heater is thermally separated from the filter element through at least one of the air and the exhaust gas in the chamber to prevent an excessive and/or abrupt temperature increase at a limited region of the filter element. If the exhaust gas flows into the filter element while the exhaust gas is prevented from flowing through the heater, the heater is prevented from being contaminated by the exhaust gas.

According to the present invention, a method for regeneration a purifier for removing particulates from an exhaust gas, comprises the steps of: measuring a pressure difference of air across a substantially invariable air flow resistance before the air reaches a filter element collecting and storing the particulates therein, and adjusting a flow rate of the air supplied to the filter element in such a manner that a difference between the pressure difference and a reference pressure difference is a predetermined value (for example, zero), while heating the air. Since the difference between the pressure difference and a reference pressure difference is a predetermined value (for example, zero) while heating the air, the (particularly in terms of mass) flow rate of the heated air is correctly measured or obtained. Therefore, the particulates are burnt constantly over the whole of the filter element, and a local temperature difference and a quick temperature change in the filter element are restrained to prevent a damage or thermal shock to the filter element.

If at least one of the predetermined value, the pressure difference, and the reference pressure difference is modified in accordance with a temperature of the heated air to obtain the difference in such a manner that an influence of an air temperature change by being heated across at least a part of the heater on the pressure difference is eliminated, the mass flow rate of the air is adjusted correctly, or an error of the mass flow rate of the air relative to a desired mass flow rate thereof is measured correctly without the influence of the air temperature change on a comparison between the pressure difference and the reference pressure difference, that is, irrespective of or discounting a change of a volume flow rate or pressure difference of the air caused by the air temperature change, to keep the mass flow rate of the air at a desired degree.

Most preferably for easy calculation, the reference pressure difference is modified to increase substantially in proportion to an absolute temperature of the air measured after the air is heated by the at least a part of the heater or in accordance with an increase of the absolute temperature thereof so that the influence is eliminated before calculating the difference. Preferably, the measured pressure difference is modified to decrease substantially in inverse proportion to the absolute temperature of the heated air or in accordance with the increase of the absolute temperature thereof so that the influence is eliminated before calculating the difference. Preferably, the predetermined value is modified to decrease in substantially inverse proportion to the absolute temperature of the heated air or substantially in accordance with the increase of the absolute temperature thereof so that the influence is eliminated. Preferably and alternatively the predetermined value is modified to increase substantial in proportion to the absolute temperature of the heated air or in substantial accordance with the increase of the absolute temperature thereof so that the influence is eliminated.

DETAILED DESCRIPTION OF PREFERRED EMBODIMENTS

Figure 1:
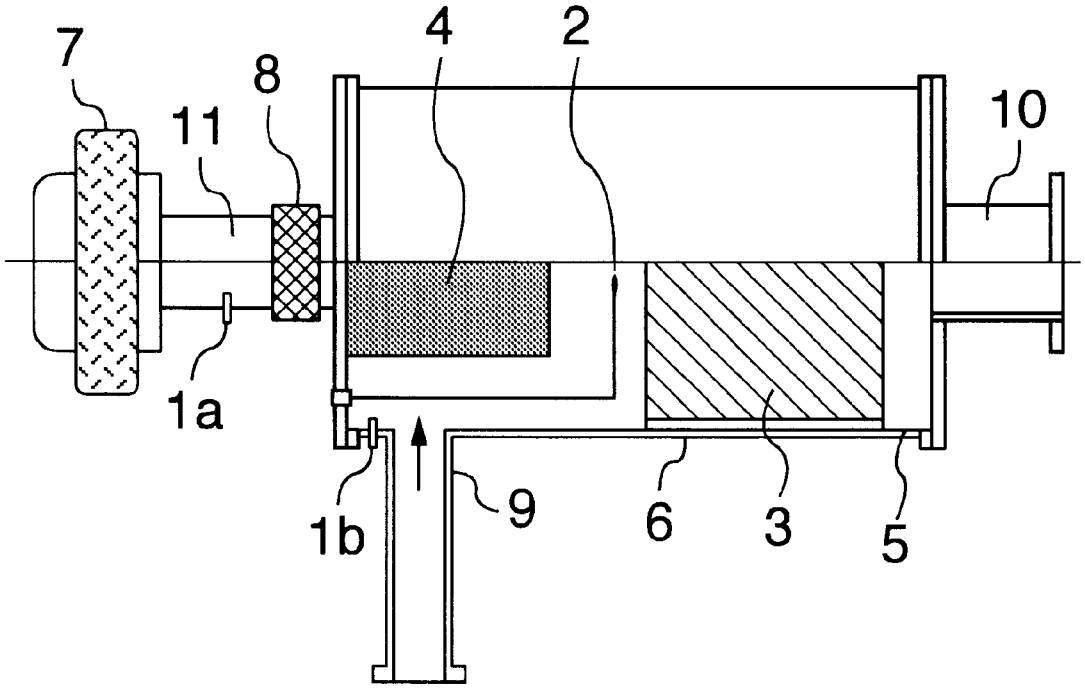
FIG. 1 is a partially cross-sectional view showing a purifier of the invention.

As shown in FIG. 1, a purifier has a first pressure sensor 1*a* at an upstream side of an electric heater 4, a second pressure sensor 1*b* at a downstream side of the electric heater 4, a temperature sensor 2 at the downstream side of the electric heater 4, a filter element 3 for collecting and storing particulates of an exhaust gas, a container 5 supporting therein the electric heater 4 and the filter element 3, a seal 6 for hermetic sealing between the container 5 and the filter element 3, an air blower 7 for urging air into the filter element 3 through an air inlet pipe 11, the electric heater 4 and a valve 8 which is closed when the exhaust gas is introduced into the purifier through an exhaust gas inlet 9 and which is opened when the air is supplied to the filter element 3 to burn the particulates, and an exhaust gas outlet pipe 10 through which the exhaust gas is discharged from the purifier after the particulates are collected by the filter element 3 from the exhaust gas. A combination of the first and second pressure sensors 1*a*, 1*b* measures a pressure difference across a invariable flow resistance formed by the heater 4 and the valve 8. The temperature sensor 2 measures a temperature of the air supplied into the filter element 3 after being heated by the electric heater 4.

For the first and second pressure sensors 1*a*, 1*b*, a diaphragm-type pressure transducer in which a stress of a diaphragm corresponding to the pressure is detected by a strain gauge and air is supplied onto the diaphragm through a conduit, a piezo-electric type pressure transducer, an electromagnetic conduction type pressure transducer, an electrical capacitance type pressure transducer, a vibration type pressure transducer or the like is used. For the temperature sensor 2, a thermocouple, a thermister thermometer or the like is used.

For the filter element 3, an sintered body made of mulite, cordierite or the like with well-through type honeycomb cylinder shape is used. A diameter thereof is about 10–33 cm, a length thereof is about 12–36 cm, and a cell number per 6.45 $cm^2$ thereof is 50–400. The filter element 3 can collect and store 1–30 gram of the particulates per 1 liter of the exhaust gas.

For the electric heater 4, a Nichrome wire, a kanthal wire, a ceramic heater or the like is used.

The container 5 is made of a heat-resisting metal or the like, and the seal 6 with a large thermal expansion coefficient is arranged between the container and the filter element 3 to prevent a leakage of the particulates therebetween. It is preferable for restraining a temperature variation of the filter element in a radial direction thereof that the container 5 is surrounded by a heat insulating member of, for example, a glass or ceramic wool, a vacuumed chamber or the like.

For the air blower 7, an axial flow blower with a relatively low output pressure in comparison with a diaphragm air pump is used to supply air at a rate of about 1000 liter/minute to the filter element 3. A circulation of the heated air provides a utilization of exhaust gas heat energy and/or is effective for decreasing electric power for heating the air. The exhaust gas inlet 9 and the exhaust gas outlet pipe 10 are formed by a heat-resisting and corrosion-resisting metal or the like, for example, stainless steel.

The particulates include soluble organic matter (SOF) which cannot be burnt and stored in the filter element 3. Therefore, A honeycomb shaped SOF oxidizing catalyser including, for example, rare metal, is preferably arranged adjacent to the filter element 3 so that a discharge of the soluble organic matter from the purifier is prevented.

Figure 2:
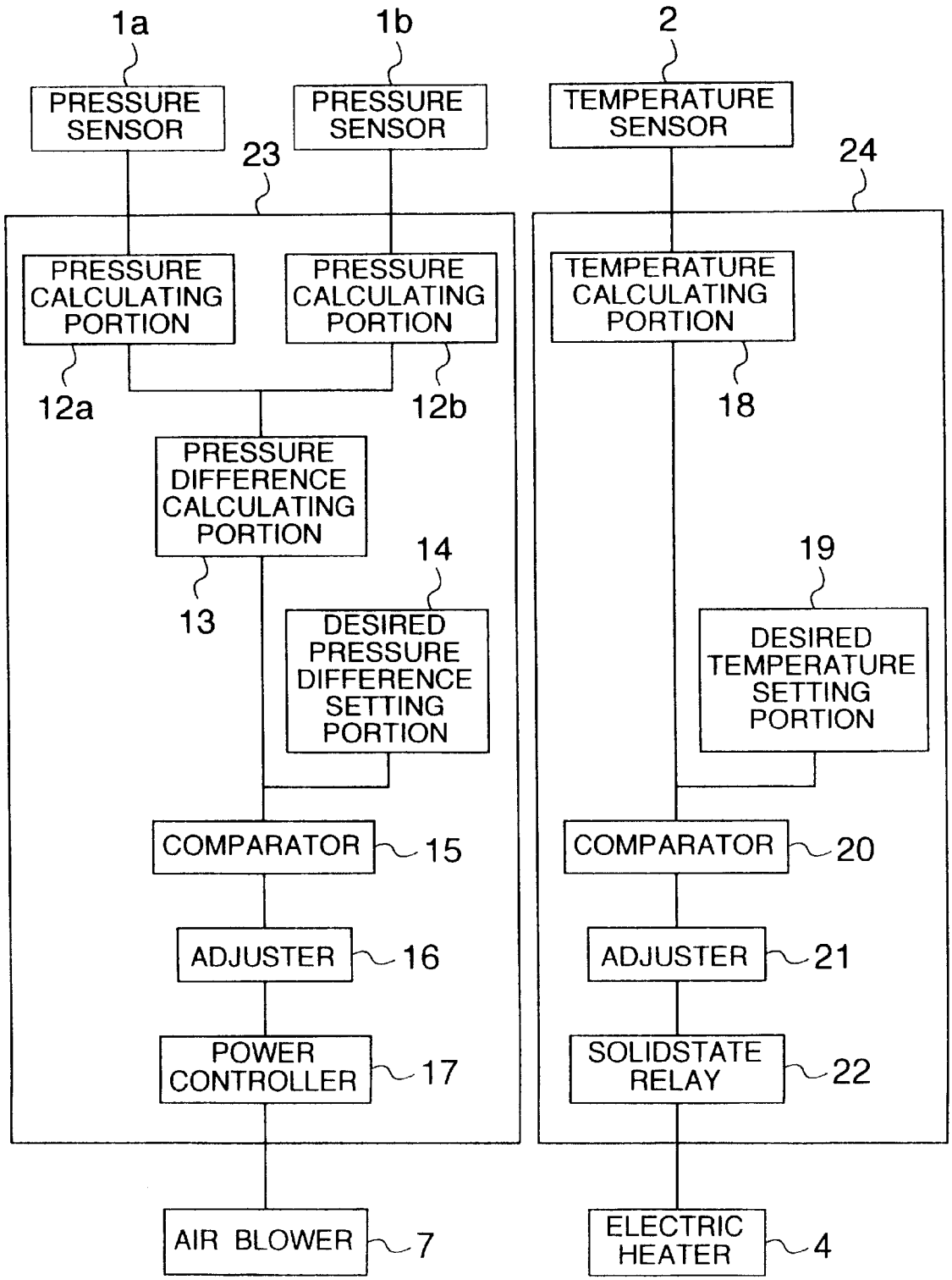
FIG. 2 is a schematic view showing a controller for the purifier.

As shown in FIG. 2, a controller includes a flow rate controller 23 and an air heater controller 24. In the flow rate controller 23, outputs of the pressure sensors 1*a* and 1*b* are converted to respective pressure value data by pressure calculating portions 12*a* and 12*b*, a pressure difference calculating portion 13 calculates a pressure difference across the claimed substantially invariable air flow resistance from the pressure value data, a comparator 15 calculates a difference between the pressure difference and a reference pressure difference set by a desired pressure difference setting portion 14, an adjuster 16 outputs or changes an air blower operating degree signal for making the difference substantially equal to a predetermined or desired value (for example, zero), and a power controller 17 outputs or changes an electric power to the air blower 7 in accordance with the air blower operating degree signal so that an output air flow of the air blower 7 is adjusted to a desired flow rate (preferably, mass flow rate). In the desired pressure difference setting portion 14 and/or the adjuster 16, at least one of the reference pressure, the reference pressure difference and the predetermined value may be modified in such a manner that an influence on the difference of a part of the pressure difference generated by an air temperature change while the air is heated by the electric heater 4 is eliminated, that is, the difference corresponds to a difference (which may be a desired difference) between an actual mass flow rate of the air and a predetermined (or desired) mass flow rate of the air, and the difference does not correspond to a difference between an actual volume flow rate of the air and a predetermined or desired volume flow rate of the air.

Most preferably, the reference pressure difference is modified so that the reference pressure difference is=

C*(absolute temperature of the air measured by temperature sensor 2).

C is determined according to the desired mass flow rate of the air.

The absolute temperature=273+centigrade temperature (°C.) of the air

In the air heater controller 24, an output of the temperature sensor 2 is converted to temperature value data by a temperature calculating portion 18, a comparator 20 calculates a temperature difference between the temperature value data and a reference temperature set by a desired temperature setting portion 14, an adjuster 21 outputs or changes an electric heater operating degree signal for making the temperature difference equal to a predetermined or desired value (for example, zero), and a solid-state relay 22 outputs or changes an electric power to the electric heater 4 in accordance with the electric heater operating degree signal so that an output heat energy of the electric heater 4 is adjusted to a desired heat energy.

Figure 3:
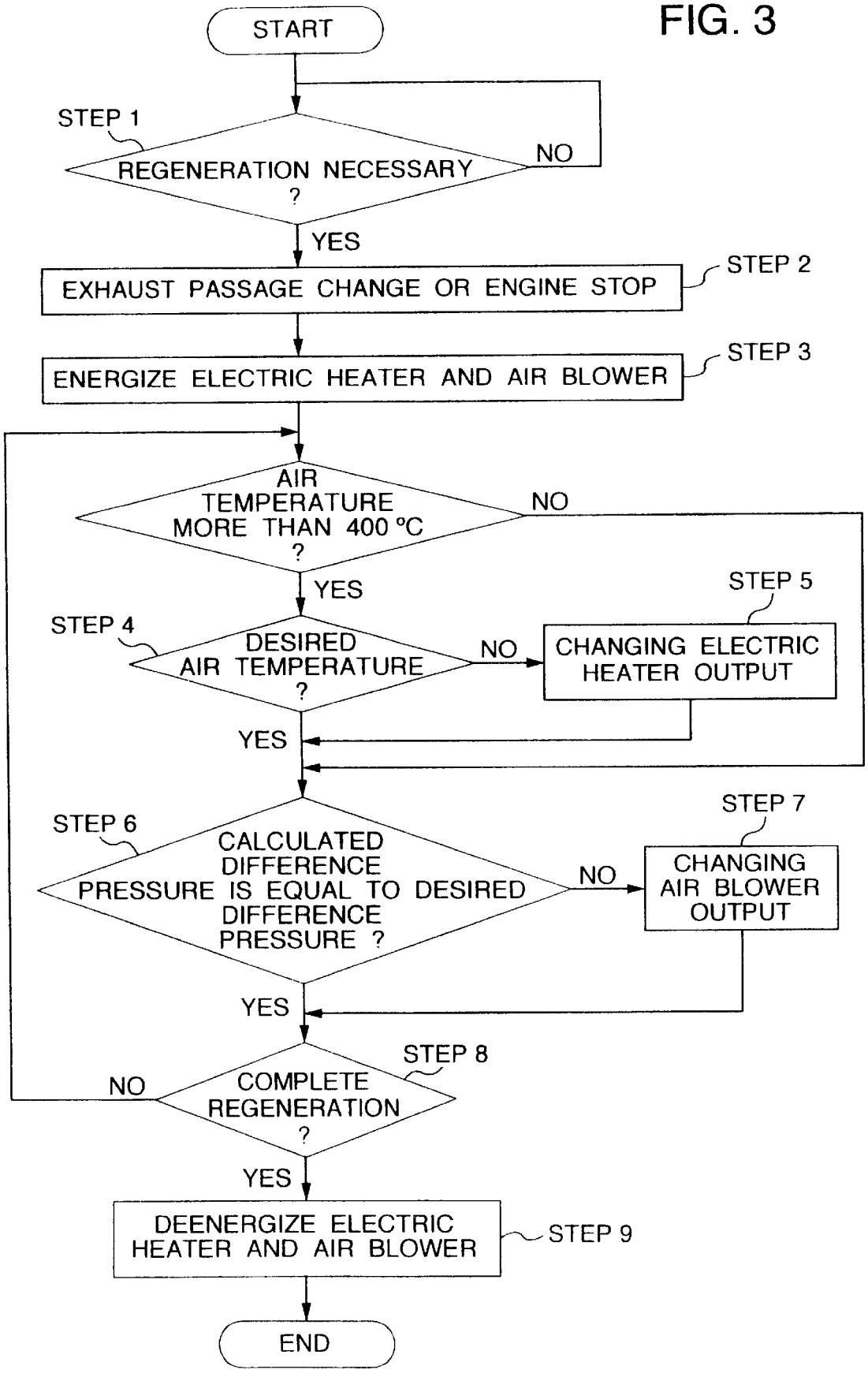
FIG. 3 is a flow chart showing controlling steps of the purifier.

As shown in FIG. 3, firstly at step 1, it is judged whether or not the purifier should be regenerated by burning the particulates while supplying the heated air into the filter element 3 in consideration of a clogged degree of the filter element 3 known from, for example, a pressure difference across the filter element 3 measured by the pressure sensor 1*b* when the valve 8 is closed to introduce the exhaust gas into the purifier, a total time of exhaust gas source (for example, engine, burner or the like) operation after a previous purifier regeneration, or the like. If the purifier should be regenerated, a supply of the exhaust gas into the purifier is stopped at step 2 by stopping the exhaust gas source operation or introducing the exhaust gas into another purifier. Subsequently, the electric heater 4 and the air blower 7 are energized at step 3 to start the purifier regeneration.

If the air temperature measured by the temperature sensor 2 is increased to 400° C., it is judged in step 4 whether or not the air temperature is substantially equal to the desired air temperature. If the air temperature measured by the temperature sensor 2 is not increased to 400° C., it is judged in step 6 whether or not the difference is substantially equal to the predetermined value (or whether or not the pressure difference is equal to the reference pressure difference when the predetermined value is zero) without the air blower output control. When the air temperature is substantially equal to the desired air temperature, it is judged in step 6 whether or not the difference is substantially equal to the predetermined value (or whether or not the pressure difference is equal to the reference pressure difference when the predetermined value is zero) without changing the electric heater output. When the air temperature is not substantially equal to the desired air temperature, the electric heater output control or change by the air heater controller 24 is performed at step 5, and subsequently the step 6 is performed.

When the difference is not substantially equal to the predetermined value, the air blower output control or change by the flow rate controller 23 is performed at step 7; subsequently, whether or not the purifier regeneration is completed is judged at step 8 from, for example, a decrease of the pressure difference across the filter element 3 (corresponding to the clogged degree of the filter element 3), a total time of the heated air supply or the like. When the difference is substantially equal to the predetermined value, it is judged in step 8 whether or not the purifier regeneration is completed without changing the air blower output.

When the purifier regeneration is completed, the electric heater 4 and the air blower 7 are deenergized at step 9. When the purifier regeneration is not completed, a judgement as to whether or not the air temperature measured by the temperature sensor 2 is increased to 400° C. is restarted to proceed to the following steps.

Figure 6:
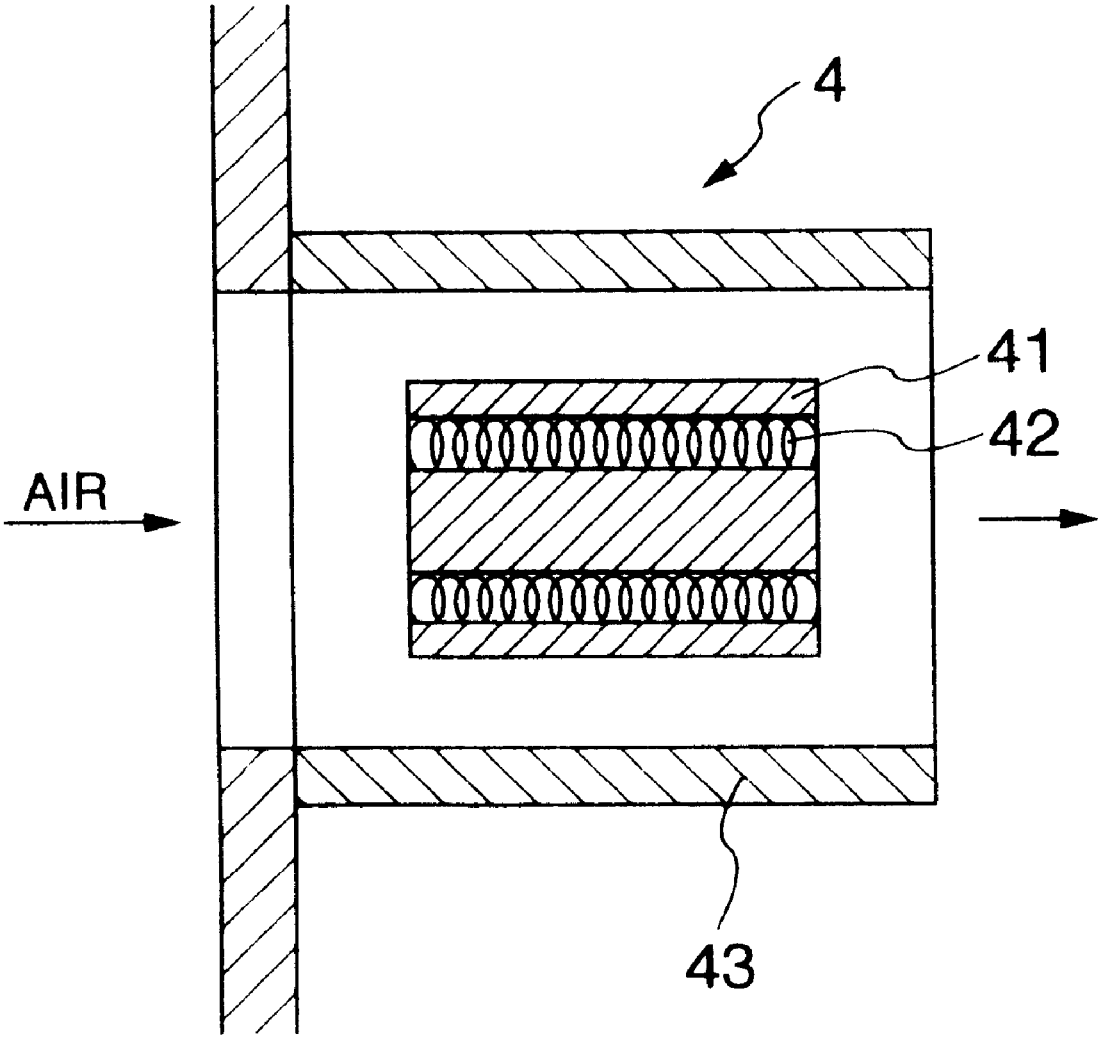
FIG. 6 is a cross sectional view showing an air passage in a heater of the purifier.

As shown in FIG. 6, the electric heater 4 includes a heater core 41 with an outer diameter of 100 mm and a length 150 mm, and an outer envelope 43 supporting the heater core 41 therein. The heater core 41 has three axial through holes with respective diameter 30 mm, and a combination 42 of a coil-shaped heating wire and a ceramic bar surrounded by the heating wire is received in each of the through holes. When the air flows at a rate of 500 liter/minute and is heated to 650° C. through the heater 4, a pressure difference across the heater 4 is about 120 mmAq.

Figure 4:
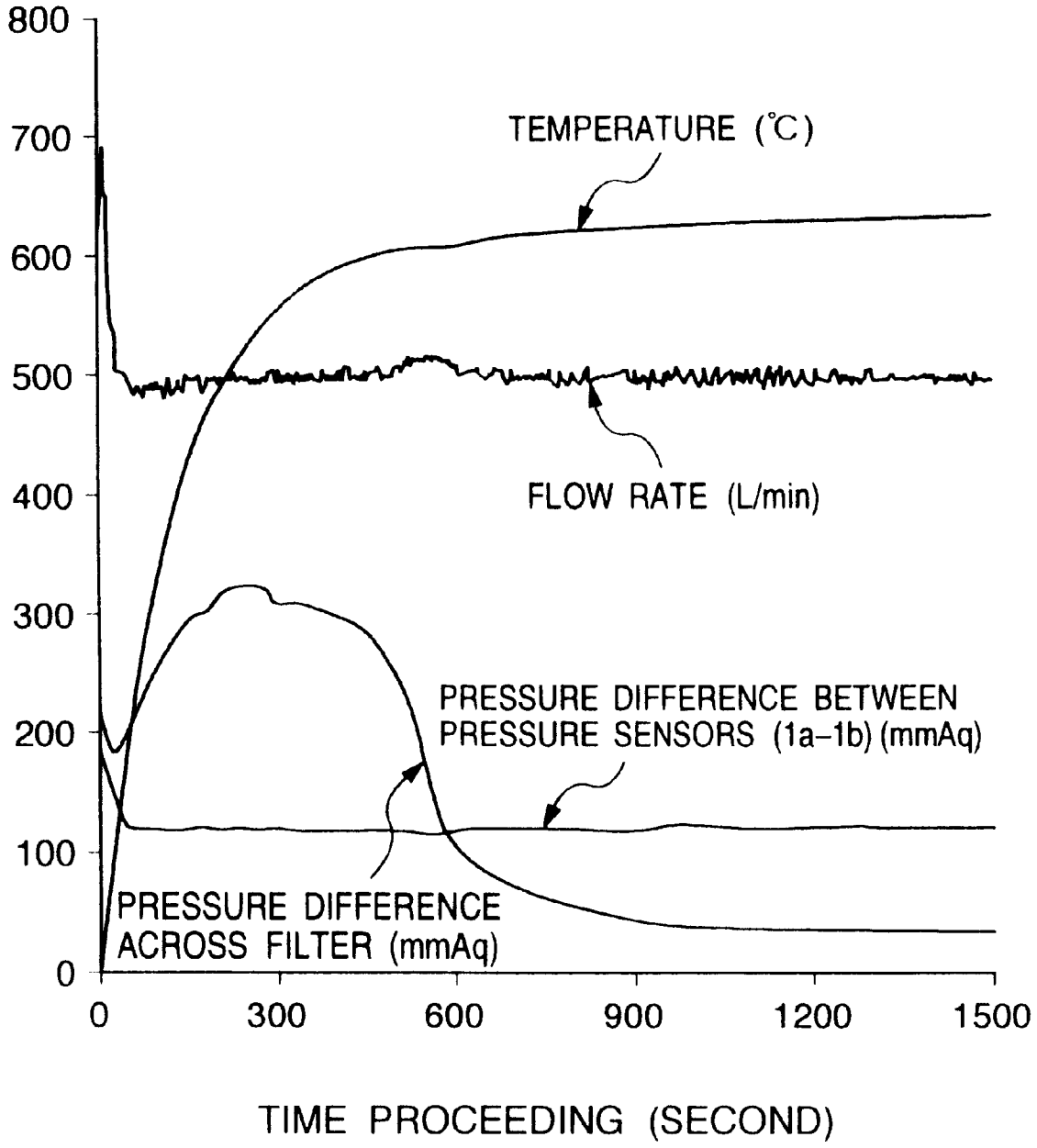
FIG. 4 is a diagram showing variations of air-temperature, air-mass-flow-rate, pressure difference between pressure sensors and pressure difference across filter element obtained in the purifier.

FIG. 4 shows variations of an air temperature measured by the temperature sensor 2, an air-mass flow rate measured by a mass flow meter between the air blower 7 and the electric heater 4, a pressure difference between the pressure sensors 1*a*, 1*b*, and a pressure difference across the filter element 3 (that is, a pressure difference between the pressure measured by the pressure sensor 1*b* and the atmospheric pressure), obtained when the air blower is controlled according to proportional plus integral plus derivative (PID) control so that the pressure difference between the pressure sensors 1*a*, 1*b* is 120 mmAq while the air is heated to 650° C. In this experimental result, the mass flow rate through the purifier is quickly settled to about 500 (normal) liter/minute of desired mass flow rate according to an air temperature increase, although the mass flow rate increases abruptly and excessively just after energizing the heater 4 and the air blower 7. Further, the mass flow rate through the purifier is kept constant irrespective of a decrease of the pressure difference across the filter element 3 caused by a proceeding of burning the particulates in the filter element 3.

Figure 5:
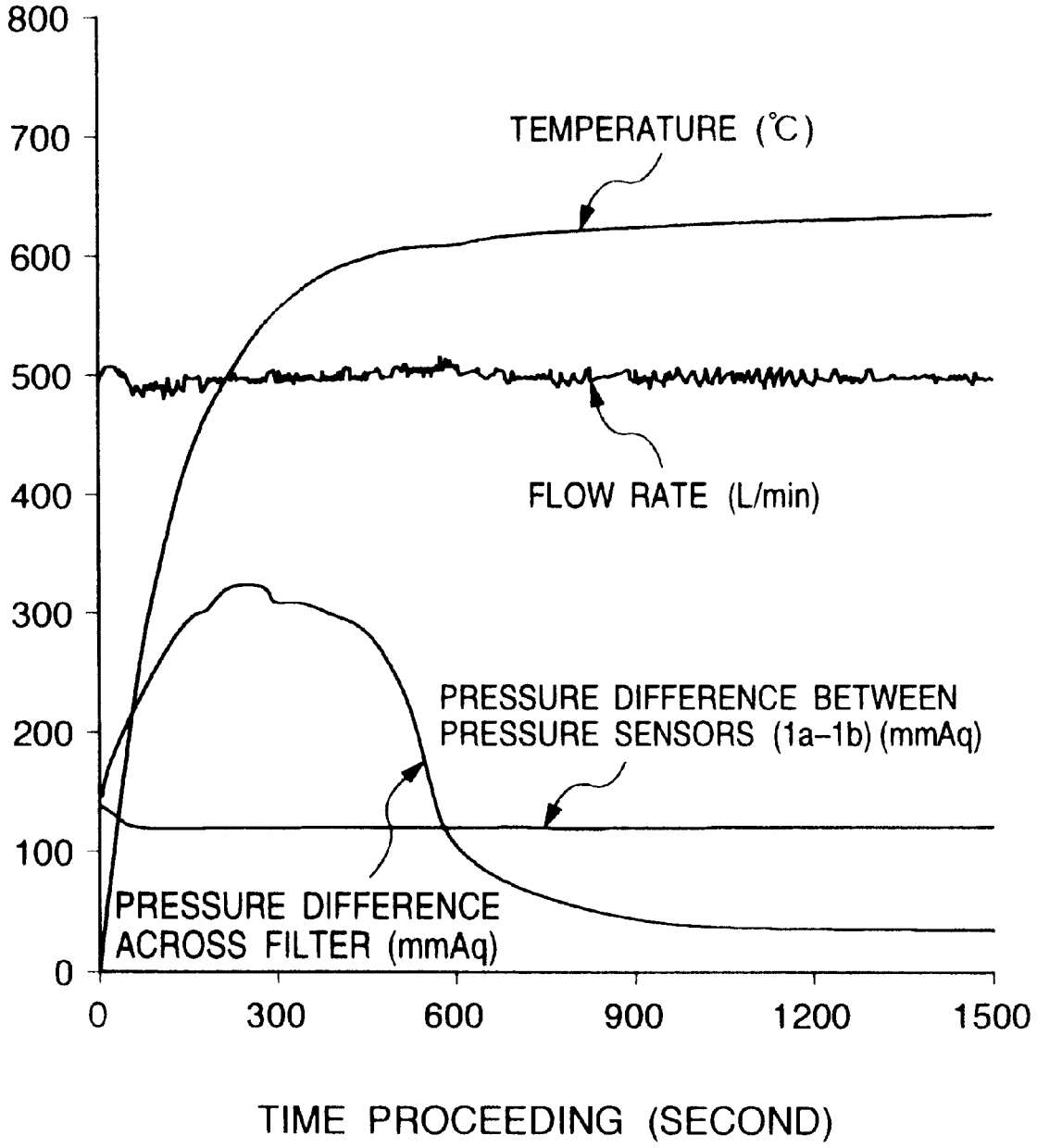
FIG. 5 is a diagram showing the other variations of air-temperature, air-mass-flow-rate, pressure difference between pressure sensors and pressure difference across filter element obtained in the purifier.

FIG. 5 shows the other variations of the air temperature, the air-mass flow rate, the pressure difference between the pressure sensors 1*a*, 1*b*, and the pressure difference across the filter element 3, obtained when the reference pressure difference is=C (=0.13)*(absolute temperature of the air measured by temperature sensor 2), and the air blower is controlled according to the proportional plus integral plus derivative (PID) control so that the pressure difference between the pressure sensors 1*a*, 1*b* is equal to the reference pressure difference while the air is heated to 650° C. In this experimental result, the mass flow rate through the purifier is more quickly settled to about 500 (normal) liter/minute, and is kept more stably constant in the previous embodiment.

What is claimed is:

1. A purifier for removing particulates from an exhaust gas, the purifier comprising:

a filter element for collecting the particulates from the exhaust gas and for storing the particulates in the filter element;

an air supplier for causing a flow of air in a flow direction toward the particulates in the filter element, the purifier having a substantially invariable air flow resistance between a downstream side of the air supplier and an upstream side of the filter element in the flow direction;

a heater for heating the air before the air reaches the particulates;

a first pressure sensor and a second pressure sensor for measuring a pressure difference of the air across the substantially invariable air flow resistance before the air reaches the filter element; and a flow rate adjuster for adjusting, while the heater heats the air, a flow rate of the air supplied to the filter element such that a difference between the pressure difference measured by the first pressure sensor and the second pressure sensor and a reference pressure difference is substantially equal to a predetermined value.

2. A purifier according to claim 1, further comprising an exhaust gas inlet opening between the filter element and at least a part of the heater to introduce the exhaust gas into the purifier between the filter element and said at least a part of the heater.

3. A purifier for removing particulates from an exhaust gas, the purifier comprising:

a filter element for collecting the particulates from the exhaust gas and for storing the particulates in the filter element;

an air supplier for causing a flow of air in a flow direction toward the particulates in the filter element, the purifier having a substantially invariable air flow resistance between a downstream side of the air supplier and an upstream side of the filter element in the flow direction;

a heater for heating the air before the air reaches the particulates; and a first pressure sensor and a second pressure sensor for measuring a pressure difference of the air across the substantially invariable air flow resistance before the air reaches the filter element;

wherein the substantially invariable air flow resistance is at least partially formed by at least a part of the heater.

4. A purifier for removing particulates from an exhaust gas, the purifier comprising:

a filter element for collecting the particulates from the exhaust gas and for storing the particulates in the filter element;

an air supplier for causing a flow of air in a flow direction toward the particulates in the filter element, the purifier having a substantially invariable air flow resistance between a downstream side of the air supplier and an upstream side of the filter element in the flow direction;

a heater for heating the air before the air reaches the particulates;

a first pressure sensor and a second pressure sensor for measuring a pressure difference of the air across the substantially invariable air flow resistance before the air reaches the filter element; and adjusting means for adjusting the flow of the air toward the filter element in such a manner that a difference between the measured pressure difference and a reference pressure difference is a predetermined value, and for modifying at least one of the predetermined value, the reference pressure difference and the measured pressure difference in accordance with a temperature of the air measured after the air is heated by at least a part of the heater, so that a mass flow rate of the air is adjusted at a desired degree.

5. A purifier for removing particulates from an exhaust gas, the purifier comprising:

a filter element for collecting the particulates from the exhaust gas and for storing the particulates in the filter element;

an air supplier for causing a flow of air in a flow direction toward the particulates in the filter element, the purifier having a substantially invariable air flow resistance between a downstream side of the air supplier and an upstream side of the filter element in the flow direction;

a heater for heating the air before the air reaches the particulates;

a first pressure sensor and a second pressure sensor for measuring a pressure difference of the air across the substantially invariable air flow resistance before the air reaches the filter element; and adjusting means for adjusting the flow of the air toward the filter element in such a manner that a difference between the measured pressure difference and a reference pressure difference is a predetermined value, and for modifying at least one of the predetermined value, the reference pressure difference and the measured pressure difference in accordance with a temperature of the air measured after the air is heated by at least a part of the heater, so that a mass flow rate of the air is adjusted at a desired degree, wherein the adjusting means comprises means for modifying at least one of the predetermined value, the reference pressure difference and the measured pressure difference such as to eliminate an influence on the difference by a part of the pressure difference generated by an air temperature change while the air is heated.

6. A purifier for removing particulates from an exhaust gas, the purifier comprising:

a filter element for collecting the particulates from the exhaust gas and for storing the particulates in the filter element;

an air supplier for causing a flow of air in a flow direction toward the particulates in the filter element, the purifier having a substantially invariable air flow resistance between a downstream side of the air supplier and an upstream side of the filter element in the flow direction;

a heater for heating the air before the air reaches the particulates;

a first pressure sensor and a second pressure sensor for measuring a pressure difference of the air across the substantially invariable air flow resistance before the air reaches the filter element; and adjusting means for adjusting the flow of the air toward the filter element in such a manner that a difference between the measured pressure difference and a reference pressure difference is a predetermined value, and for modifying at least one of the predetermined value, the reference pressure difference and the measured pressure difference in accordance with a temperature of the air measured after the air is heated by at least a part of the heater, so that a mass flow rate of the air is adjusted at a desired degree, wherein the adjusting means comprises means for modifying the reference pressure difference to be substantially in proportion to an absolute temperature of the heated air such as to eliminate an influence on the difference by a part of the pressure difference generated by an air temperature change while the air is heated.

7. A purifier according to claim 1, further comprising a temperature sensor for measuring a temperature of the air, and wherein the adjusting means comprises means for adjusting an output of the heater in such a manner that the temperature is substantially equal to a desired temperature.

8. A purifier according to claim 1, further comprising a temperature sensor for measuring a temperature of the air after the air is heated by at least a part of the heater.

9. A purifier according to claim 1, further comprising a temperature sensor for measuring a temperature of the air before the air flows out from the filter element.

10. A purifier according to claim 1, further comprising: a temperature sensor for measuring a temperature of the air; and an exhaust gas inlet disposed such that the exhaust gas flows into the purifier in an exhaust gas flow direction;

wherein the temperature sensor and the exhaust gas inlet are disposed such that the temperature sensor is prevented from directly facing the exhaust gas inlet in the exhaust gas flow direction.

11. A method for regenerating a purifier for removing particulates from an exhaust gas, the method comprising:

(a) collecting and storing the particulates in a filter element;

(b) supplying air to the filter element while measuring with a first pressure sensor and a second pressure sensor a pressure difference of the air across a substantially invariable air flow resistance between a downstream side of the air supplier and an upstream side of the filter element; and (c) adjusting a flow rate of the air supplied to the filter element in such a manner that a difference between the pressure difference measured in step (b) and a reference pressure difference is substantially equal to a predetermined value, while heating the air.

12. A method for regenerating a purifier for removing particulates from an exhaust gas, the method comprising:

(a) collecting and storing the particulates in a filter element;

(b) supplying air to the filter element while measuring with a first pressure sensor and a second pressure sensor a pressure difference of the air across a substantially invariable air flow resistance between a downstream side of the air supplier and an upstream side of the filter element; and (c) adjusting a flow rate of the air supplied to the filter element in such a manner that a difference between the pressure difference measured in step (b) and a reference pressure difference is substantially equal to a predetermined value, while heating the air;

wherein step (c) comprises modifying at least one of the predetermined value, the reference pressure difference and the pressure difference measured in step (b) in accordance with a temperature of the air heated in step (c) in such a manner that a part of the pressure difference measured in step (b) which is caused by an air temperature change while the air is heated does not affect the difference between the pressure difference measured in step (b) and the reference pressure difference, so that a mass flow rate of the air is adjusted to a desired degree.

13. A method for regenerating a purifier for removing particulates from an exhaust gas, the method comprising:

(a) collecting and storing the particulates in a filter element;

(b) supplying air to the filter element while measuring with a first pressure sensor and a second pressure sensor a pressure difference of the air across a substantially invariable air flow resistance between a downstream side of the air supplier and an upstream side of the filter element; and (c) adjusting a flow rate of the air supplied to the filter element in such a manner that a difference between the pressure difference measured in step (b) and a reference pressure difference is substantially equal to a predetermined value, while heating the air;

wherein step (c) comprises modifying at least one of the predetermined value, the reference pressure difference and the pressure difference measured in step (b) in accordance with a temperature of the air heated in step (c) in such a manner that a part of the pressure difference measured in step (b) which is caused by an air temperature change while the air is heated does not affect the difference between the pressure difference measured in step (b) and the reference pressure difference, so that a mass flow rate of the air is adjusted to a desired degree, wherein the reference pressure difference is modified to be substantially in proportion to an absolute temperature of the heated air.

14. A method according to claim 12, wherein step (c) further comprises measuring the temperature of the air before the air flows out from the filter element.

15. A method according to claim 11, wherein the flow rate of the air adjusted in step (c) is a mass flow rate of the air.

* * * * *